US005274852A

United States Patent [19]

Hogan

[11] Patent Number: 5,274,852

[45] Date of Patent: Jan. 4, 1994

[54] ONE PIECE, OPEN SEAM WRAPPING GARMENT FOR COVERING AND UNCOVERING THE HUMAN BODY ON-DEMAND

[75] Inventor: John D. Hogan, Gloucester, Mass.

[73] Assignee: Beth Israel Hospital Assoc. Inc., Boston, Mass.

[21] Appl. No.: 53,324

[22] Filed: Apr. 27, 1993

Related U.S. Application Data

[63] Continuation of Ser. No. 806,207, Dec. 13, 1991, abandoned.

[51] Int. Cl.[5] ..... A41D 13/00

[52] U.S. Cl. ..... 2/114; 2/105; 2/106; 2/69; 2/88

[58] Field of Search ..... 2/69, 69.5, 75, 80, 2/105, 106, 107, 104, 114, 88, 247, 406, DIG.7; 450/36, 37

[56] References Cited

U.S. PATENT DOCUMENTS

| | | | |
|---|---|---|---|
| 1,489,046 | 4/1924 | Thompson | 2/DIG. 7 X |
| 1,524,345 | 1/1925 | Du Bose | 2/75 |
| 1,797,604 | 3/1931 | Burgdorfer | 2/80 X |
| 1,799,572 | 4/1931 | Sweeney | 2/115 |
| 1,946,782 | 2/1934 | Davis | 2/71 |
| 1,998,051 | 4/1935 | Gerber | 2/114 |
| 2,206,412 | 7/1940 | Levy | 2/46 |
| 2,628,359 | 2/1953 | Shalda | 2/75 X |
| 2,671,220 | 3/1954 | Geissmann | 2/80 |
| 2,680,850 | 6/1954 | Renard | 2/114 X |
| 2,748,771 | 6/1956 | Richards | 450/36 X |
| 2,875,455 | 3/1959 | Harmon | 2/80 |
| 3,424,162 | 1/1969 | Parravicini | 2/406 X |
| 3,557,385 | 1/1971 | Hendrickson | 2/114 |
| 3,568,213 | 3/1971 | Mason | 2/80 |
| 4,074,721 | 2/1978 | Smits et al. | 450/37 |
| 4,241,462 | 12/1980 | Tagawa et al. | 2/406 |
| 4,541,129 | 9/1985 | Murakami | 2/113 |
| 4,759,083 | 7/1988 | Beldner | 2/114 |
| 4,897,885 | 2/1990 | Lunt | 2/70 X |
| 4,964,173 | 10/1990 | Gordon et al. | 2/114 |
| 4,975,984 | 12/1990 | Sting | 2/114 |
| 5,024,628 | 6/1991 | Sanchez | 450/36 |
| 5,062,159 | 11/1991 | Jakub | 2/114 |
| 5,088,117 | 2/1992 | Fulmer | 2/DIG. 7 X |
| 5,093,932 | 3/1992 | Doyle | 2/114 |

FOREIGN PATENT DOCUMENTS

| | | | |
|---|---|---|---|
| 243211 | 3/1965 | Austria | 2/114 |
| 327823 | 1/1989 | European Pat. Off. | 2/401 |

*Primary Examiner*—Clifford D. Crowder
*Assistant Examiner*—Jeanette E. Chapman
*Attorney, Agent, or Firm*—David Prashker

[57] ABSTRACT

The present invention provides a one-piece, open-seam garment which encompasses the head, covers and conforms to the body and limbs of the wearer, and provides on-demand access to one portion of the covered body and limbs without uncovering the remainder of the body and legs. When worn, the garment provides privacy and protection for the person unlike the conventionally used johnnies and hospital gowns conventionally worn during physical examination or medical treatment in the physician's office or clinic.

6 Claims, 10 Drawing Sheets

ONE PIECE, OPEN SEAM WRAPPING GARMENT FOR COVERING AND UNCOVERING THE HUMAN BODY ON-DEMAND

This application is a continuation, of application Ser. No. 806,207, filed Dec. 13, 1991.

FIELD OF THE INVENTION

The present invention is concerned generally with loosely fitting articles of clothing worn by persons undergoing a medical examination, medical treatment, or health maintenance of extended or limited duration; and is particularly directed to those garments typically used by persons as out-patients and by persons admitted to the hospital in place of street clothes or of pajamas, nightgowns, and similar attire respectively.

BACKGROUND OF THE INVENTION

The design and construction of articles of clothing for the human body has varied enormously in form and appearance; and typically is the result of a compromise between function and fashion. Thus, history has provided us with a broad variety of styled garments which were intended to protect the individual against the weather and an unpredictable environment. These include the basic articles of clothing we use today such as dresses, pants, coats, shirts, and intimate apparel; as well as outer covering garments such as overcoats, coveralls, cloaks, capes, and headgear of various kinds. In comparison, many cultures and societies have created fashionable garments which have come to represent and be associated with particular aspects or features of their race, nation, politics, or philosophy. Representative of such societal fashions are the toga, the sari, the poncho, the sarong, and the kimono. Each of these unique garments is as much a statement of the wearer's culture and civilization as they are a reflection of his need to protect himself from his environment.

It will also be appreciated that some articles of clothing are created to meet and satisfy a specific need or purpose. Thus, firemen wear protective coats and helmets; law enforcement personnel often wear bulletproof vests; surgeons wear presterilized operating gowns; cowboys wear chaps; and classical ballerinas wear tutus. Convention has also served to dictate specific fashion for appearance sake such as tuxedos and tailcoats for semi-formal and formal evening wear. In most cases, however, an accommodation made between function and fashion gives best service.

Given the long and varied history of clothing, it is therefore incongruous and incredible what a man, woman, or child is expected to wear today when being examined by his physician or when he is admitted to the hospital for medical treatment on either an elective or emergency basis. Typically, the individual is asked to undress completely and is given a single garment to wear as best he can. This garment, conventionally termed a "hospital johnnie" or "johnnie gown", is merely one-half of a shrunken night shirt of the flimsiest material. Unless the individual is extraordinarily small in height and stature, this garment is insufficient to cover the body effectively. Typically, when the person slips his hands through the sleeves and pulls the cloth up towards his neck, the hemline of the garment commonly ends above the genital area and the person's back and buttocks often remain completely exposed to the ambient environment without any covering whatsoever. The person is thus compelled to clutch the garment with both hands, often wrapping his arms around himself in order to keep the garment ends from flapping open or falling off entirely. As a consequence, even after having donned and clutched this garment, the individual remains half-naked at best and is frequently an embarrassment to himself, if not to his neighbors.

It is useful here to recall that the hospital johnnie was intended to serve several important purposes. First, the person waiting for medical examination or treatment should not be encumbered or hampered by the multiple layers of clothing normally worn as street clothing or protective articles against inclement weather. All such clothing merely acts as physical barriers to the purpose of the medical examination or treatment. Second, the physician must have access to those parts of the body which require physical examination and/or treatment; nevertheless, there is no reason for the person to be totally nude when only one limb or portion of the torso is the focus or point of interest. Third, most persons wearing a hospital johnnie feel embarrassed sitting in the presence of another fully clothed person who is a complete stranger; and the individual's own standards of personal modesty deserve respect. Lastly, it is not unusual for the medical examination and/or treatment to involve articles, fluids, and other implements which sometimes cause an unavoidable release of fluids, creams, or other discharges in the immediate area of examination or treatment. The clothing worn at that moment thus frequently becomes spotted and/or soiled; and it is advantageous that a person's personal clothing not be subjected to such accidental spillage and soiling. All of these are good and valid reasons for wearing a protective garment other than the individual's personal clothing when the person is an outpatient either at the physician's office or in a hospital clinic setting.

Equally important and more revealing is the instance of the inpatient who has been admitted to the hospital on either an elective or emergency basis. The individual's own preferred night clothing for sleeping or lounging—typically nightgowns, pajamas, robes, and housecoats—is often unsuitable in maternity wards, in surgical situations, with intravenous administration tubing and devices, as well as with the commonplace plaster casts employed with bone fractures or during irregularities of the body such as diarrhea and incontinence. The person in these medical situations often needs multiple changes of clothing in a single day; and concomitantly would benefit from wearing a kind of clothing which facilitates intermittent examinations and access of the requisite body areas and limbs at any moment. Moreover, it is commonplace to see recovering and convalescent patients walking up and down the halls and corridors of a hospital or clinic as a form of both therapy and exercise for limited duration before again returning to bed for the next several hours. The need for effective protective clothing is thus greatest when the person is a hospital inpatient.

Nevertheless, despite these many varied and compelling reasons, the traditional johnnie gown with all its well recognized deficiencies and failures continues to be used routinely as the only available type of protective garment. As strange as it may seem in this highly sophisticated and technologically advanced age, there has been no improvement or successor to the hospital johnnie other than the form in which it was introduced many decades ago. Clearly, therefore, the need for an article of clothing which not only covers the body and limbs of the wearer but also provides access when needed to the covered body and limbs would be generally recognized and acknowledged as a major improvement and innovation in this art.

SUMMARY OF THE INVENTION

The present invention provides a one-piece, open-seam garment which encompasses the head, covers and conforms to the body and the limbs of the wearer and provides on-demand access to one portion of the covered body and limbs without uncovering the remainder of the body and limbs, said garment comprising:

a single, flexible, and integral configured sheet which is substantially planar and has a fixed surface area providing at least (a) a central panel including a chest flap zone and a back section zone, (b) an opening in said central panel sufficiently large to accommodate the head of the wearer therethrough, (c) first and second configured side panels lying adjacent to said central panel along said chest flap and back section zones, (d) a configured bottom panel lying adjacent to said back section zone of said central panel, and (e) a plurality of open-seam edges delineating the shaped perimeter of said configured sheet; and a plurality of on-demand closures spaced from each other at prechosen positions along said open-seam edges of said configured sheet.

BRIEF DESCRIPTION OF THE FIGURES

The present invention may be more easily and completely understood when taken in conjunction with the accompanying drawing, in which.

DETAILED DESCRIPTION OF THE INVENTION

Figure 1:
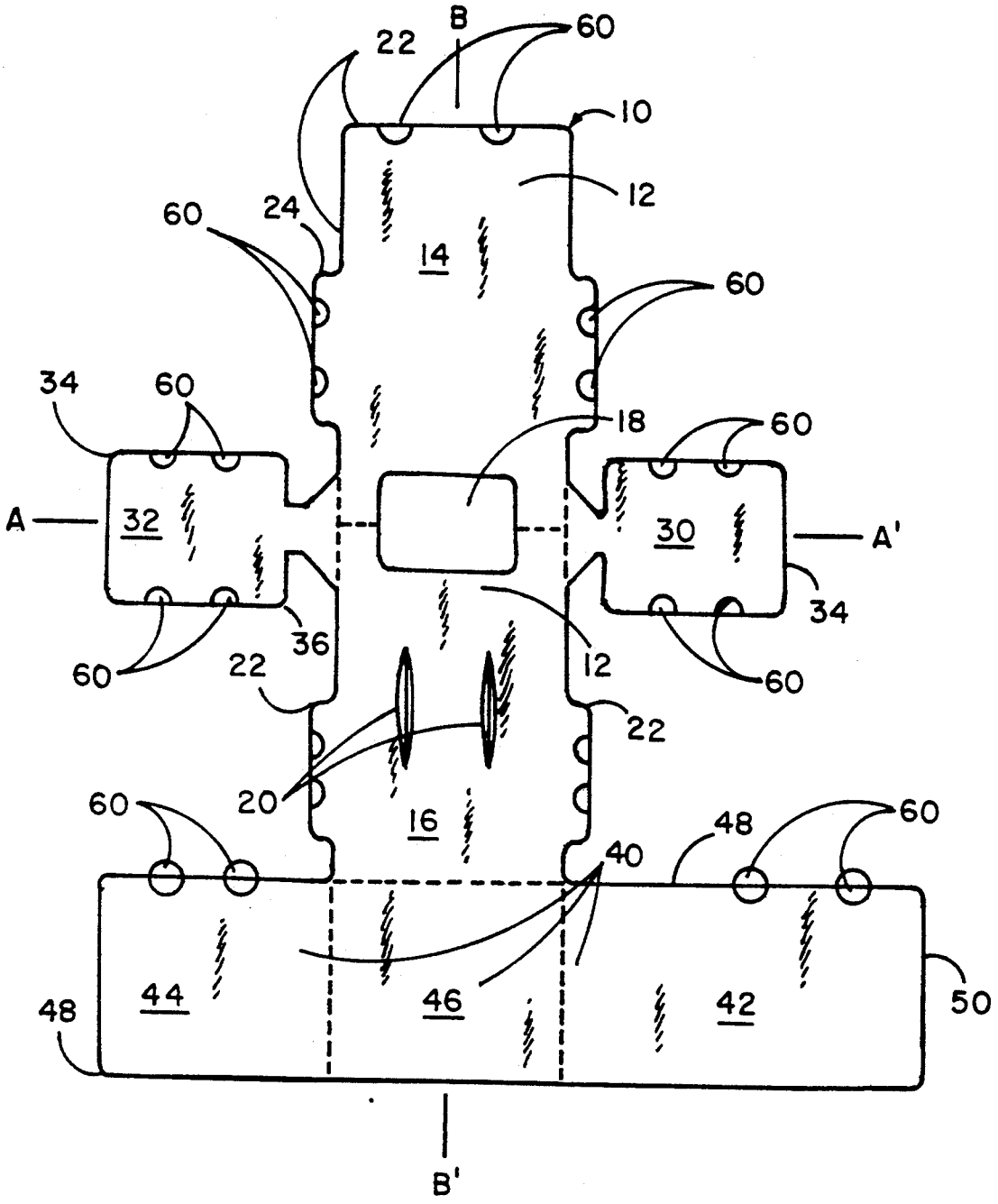
FIG. 1 is an overhead view of the unfolded generic garment which comprises the present invention.

The present invention is a one-piece, open-seam garment which is intended to be worn by a person in place of his usual clothing when undergoing a medical examination, when being given medical treatment, when admitted to the hospital as an inpatient, or when undergoing health maintenance care of any kind. The wrapper or bodycloth is easily draped over and around the body and limbs of the individual and is a complete attire suitable for lounging, lying in bed, or sleeping. By its very form and construction, the present invention provides major benefits and marked advantages over conventionally known johnnie gowns and other articles of clothing typically worn. These include the following:

1. The present invention is a single configured sheet which has an opening sufficiently large to accommodate the head of the wearer therethrough. Once draped over the head, folded, and wrapped around the body, the garment not only encompasses the head and neck of the person, but also covers and conforms to the body and limbs of the wearer. After donning the article and draping, folding, and wrapping the garment in the intended manner, the chest, back, buttocks, arms, and thighs of the person are covered and protected from the ambient environment.

2. The present invention is a one-piece, open-seam garment which provides on-demand access to one portion of the covered body and limbs of the individual without need for uncovering any other part of the body and limbs. Any part of the person is immediately accessible for either examination and/or treatment while the remainder of the body and/or limbs of the individual remains covered and protected over the duration of the examination or treatment. Thus, a right or left arm (or a right or left leg) may be uncovered and examined while the chest, back, buttocks, and genital area remain covered and clothed. Conversely, the physician may examine the chest of the person without exposing his back or examine the genital area without concomitantly uncovering either the chest or back. In this manner, both the modesty and the person of the individual remains substantially clothed and protected even in the midst of a physical examination and/or medical treatment. Similarly, the professionalism of the attending physician is also secured.

3. The present invention is a single, configured sheet which is flexible and integral; and provides a plurality of on-demand closures spaced from each other at prechosen positions along the open-seam edges of the garment. These closures may be opened and shut repeatedly as needed or required; and constitute a permanent feature of the garment itself. By choosing and shutting some of the available closures, the edges form an open-seam or gap-seam garment which clothes and conforms to the shoulders and arms as well as to the hips, thighs, and legs of the wearer. The garment thus provides a comfortable fit and effective covering for the body and limbs of the individual; and, by merely re-opening some of the shut closures, allows on-demand access to any portion of the covered body and limbs without uncovering any other major portion of the body or limbs whenever the need arises.

4. The present invention is a substantially planar sheet having a fixed surface area which is predetermined and chosen to meet the person's individual body requirements. It is expected and intended that the garment will be manufactured in at least several different sizes (typically small, medium, large, and extra-large); and that the appropriate size garment will be given to meet the demand and satisfaction of the individual's stature. At no time during use of the garment will the person find himself unintentionally half-naked and exposed without recourse to either the view of other people or the ambient environment. Moreover, no other article or item is required whatsoever to complement, supplement, or complete the garment when employed for its intended purpose. Accordingly, there is no need at all for a robe, a dressing gown, a belt, or even a safety pin in order to make maximum use of the present invention.

5. The one-piece, open-seam garment comprising the present invention may be manufactured as a long-term, repeated use item; a short-term, repeated use article; or even a one-time, single use object. Thus, the garment itself may be composed of many different kinds of materials ranging from the durable and resilient to the flimsy and fragile. In addition, the garment may be constructed as a throw away article to be discarded after one or more occasions of usage; or may be generated as an article of clothing intended to last over a plurality of years.

6. The present invention may optionally and desirably include features such as absorbent pads positioned at one or more locations over the surface area of the garment. These absorbent pads are expected and intended to be of varying size and thickness; and may be either self-adhesive or held in a particular location via a netting or similar porous support. The specific placement of the absorbent pad(s) will be chosen with regard to the needs of the intended wearer. Thus, absorbent pads placed on the chest flap zone of the garment will provide protection for women in the maternity ward. Similarly, a pad properly positioned within the bottom panel of the garment can protect the person against either incontinence or vaginal discharges. Moreover, absorbent pads and the like may be specifically positioned on the garment to provide a buffer layer such that when the garment is worn the pad covers and protects a surgical incision, an open wound, or that portion of the skin where fluids are being intravenously administered.

In order to provide a more complete and facile understanding of what the present invention is as well as to appreciate and properly recognize the novel and unique features of the invention, the description will proceed in the following sequence: a detailed disclosure of the garment generically as an article of manufacture; materials for constructing the garment and expected methods for its manufacture; preferred embodiments of the garment; and optional, but desirable, features which may be advantageously employed with the present invention. The detailed disclosures will be described seriatim.

I. The Generic Garment

The present invention is a one-piece, open-seam flexible and integral article of clothing which is illustrated in generic form by FIGS. 1–5 respectively. As shown by FIG. 1, the garment is a single, configured sheet 10 which is substantially planar and has a fixed surface area which will be determined and varied to meet the individual body requirements of the intended wearer. The configured sheet 10 is composed of several integrated parts including a central panel 12, discrete first and second configured side panels 30 and 32, and a configured bottom panel 40. While each of these panels has its own features, it is the union of these panels collectively forming an integrated unit which provides the configured sheet 10 as a whole.

The central panel 12 is divisible into and identifiable as a chest flap zone 14; a back section zone 16; an opening or aperture 18 in the midst of the central panel 12, this opening being sufficiently large to accommodate the head of the wearer therethrough; and preferably includes at least one slit 20 within the back section zone 16. The edges 22 of the central panel 12 delineates the shaped perimeter 24 of the central panel and provides a plurality of open seams for the configured sheet 10 as a whole.

The first configured side panel 30 lies adjacent to the central panel 12 along the chest flap zone 14 and the back section zone 16 as shown in FIG. 1. Similarly, the second configured side panel 32 also lies adjacent to the central panel 12 along the other side of the chest flap zone 14 and the back section zone 16 as illustrated. It is desirable, but not essential, that the opening 18 in the central panel 12 be aligned along a common axis AA' as this will provide for a more comfortable and proper fit for the wearer. Similarly, it is desirable, but not essential, that the slits 20 lie in a common axis BB' with regard to the opening 18 in the central panel 12. The edges 34 of the first and second side panels 30,32 delineate the shaped perimeter 36 of the panels and also provide a plurality of open seams for the configured sheet 10.

The configured bottom panel 40 is joined to the central panel 12 adjacent to the back section zone 16 as shown. The configured bottom panel 40 appears in substantially rectangular form within FIG. 1, but may be constructed in a broad variety of different regular and irregular geometric shapes as will be described subsequently herein. Within the generic embodiment illustrated by FIGS. 1–5 respectively, the bottom panel 40 is not only elongated but also lies adjacent to the central panel 12 such that a first bottom end 42, a second bottom end 44, and a middle bottom area 46 are formed. The first bottom end 42 is desirably configured such that it has a larger surface area than the second bottom end 44, as seen in FIG. 1. In other embodiments where the bottom panel 40 is alternatively shaped, the first bottom end 42 and the second bottom end 44 often are substantially similar in fixed surface area. For purposes of the generic garment, however, the configuration and relative surface areas are desirably as shown in FIG. 1. As before, the edges 48 delineate the shaped perimeter 50 of the configured bottom panel 40 and provide another plurality of open seams for the configured sheet 10 as a whole.

The unitary configured sheet 10 is thus the integral union of the central panel 12, the first and second side panels 30,32, and the bottom panel 40. Concomitantly, the shaped perimeter of the configured sheet 10 is delineated by the edges 22,34,48 which cumulatively and collectively delineate the overall shaped perimeter of the garment as a discrete unit. Moreover, it is along these open-seam edges of the configured sheet that a plurality of on-demand closures 60 are located, each of these closures 60 being spaced from the other at a variety of prechosen positions along the open-seam edges of the configured sheet. Each closure 60 may be repeatedly shut and opened at will; and each closure 60 is a permanent fixture and feature of the open-seamed edges of the configured sheet 10 as a whole.

Figure 2:
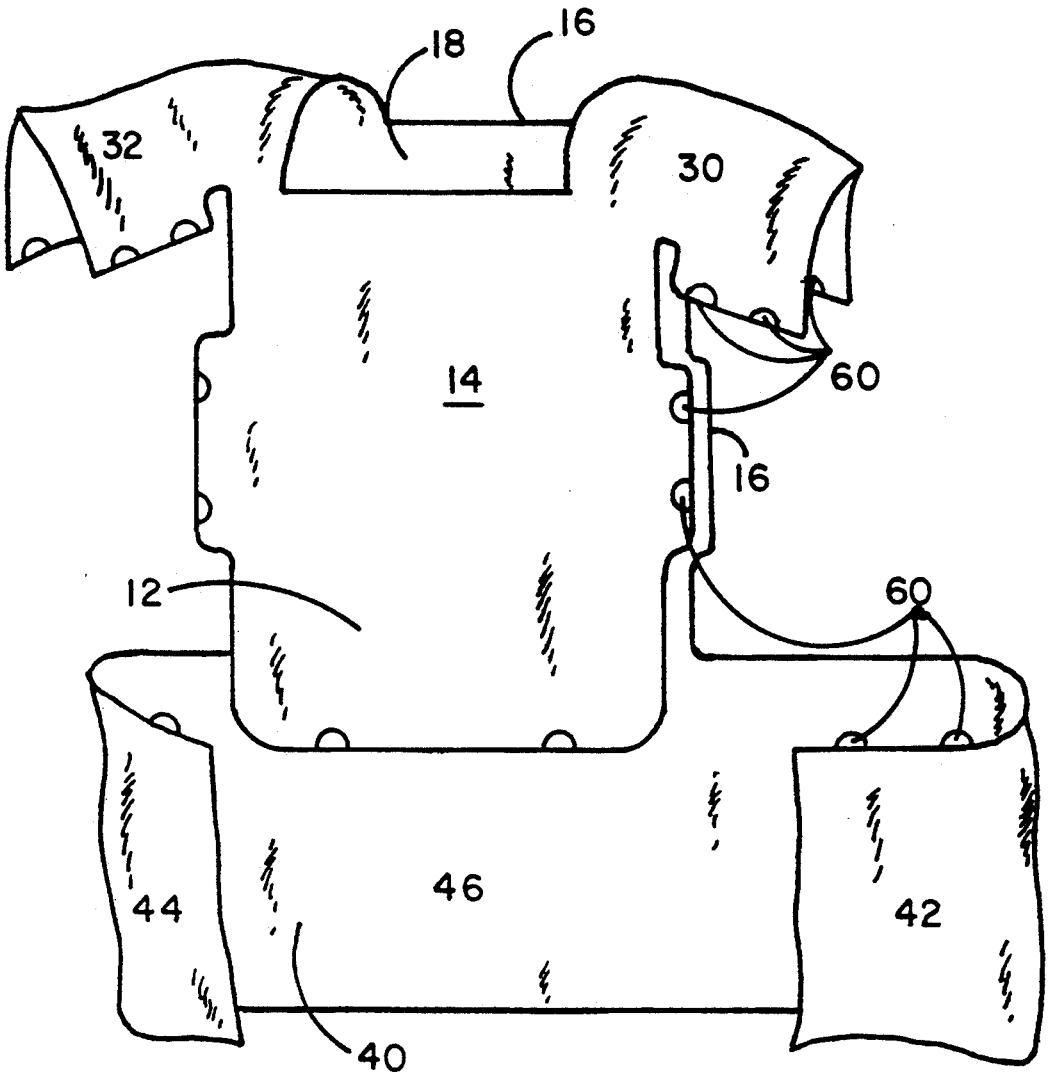
FIG. 2 is a front, perspective view of the generic garment of FIG. 1 when draped as intended.

A front perspective view of the configured garment of FIG. 1 as it is intended to be worn on the body is shown by FIG. 2. In this generic embodiment, it is intended that the head and neck of the person actually pass through the opening 18 in order to properly drape the garment on the body prior to folding and wrapping the various parts of the garment around the body and limbs. The configured sheet 10 is placed over the head and neck of the person such that the chest flap zone 14 comes to rest against the chest of the wearer and the back section zone 16 comes to rest adjacent the spine of the person. Similarly, the configured side panels 30,32 will lie against, drape over, and conform to the right and left shoulders and arms. Concurrently, the bottom panel 40 will surround and encompass the hips, thighs, and legs of the wearer. It is expected and intended that the first bottom end 42 and the second bottom end 44 of the bottom panel 40 will be first folded around the hips, thighs, and upper legs of the individual; and then be wrapped around the body in overlapping fashion to form an enveloping, draped skirt.

Figure 3:
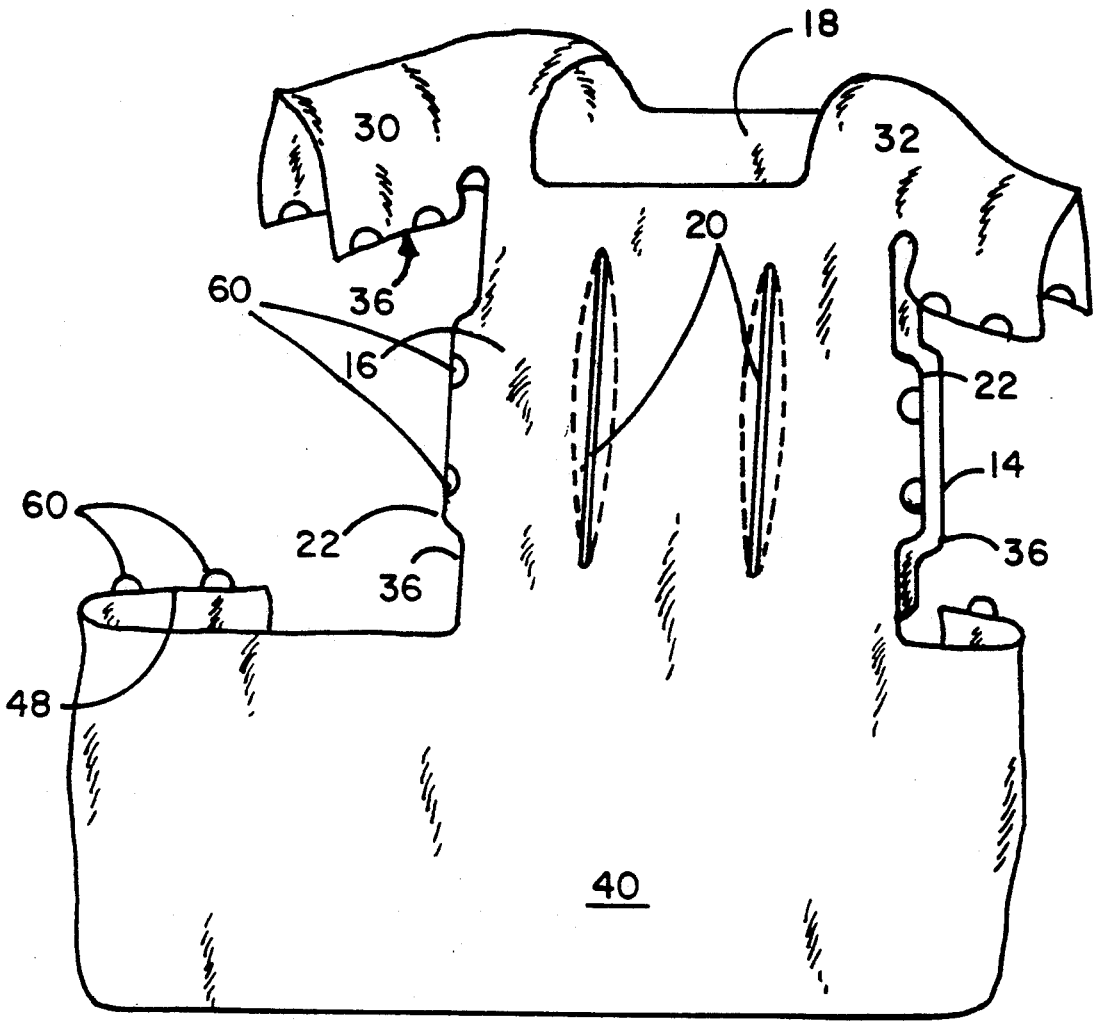
FIG. 3 is a rear, perspective view of the generic garment of FIG. 1 when draped as intended.

The rear perspective view of the configured sheet 10 after the head of the wearer has passed therethrough the opening 18 is illustrated by FIG. 3. Note that the chest flap zone 14 desirably becomes aligned with and is proportional to the back section zone 16 such that the separate zones of the central panel 12 lie in relative parallel format. The closures 60 positioned along the open-seamed edges 22 allow the person to join the chest flap zone 14 directly to the back section zone 16 at a plurality of locations along the shaped perimeter 36. The closures 60 along the edges 22 may be found at both sides of the central panel and thus the open-seamed edges may be joined at a number of prechosen positions while nevertheless maintaining an open-seam or gap-seam for the garment. Also, the closures 60 along the edges of the first and second side panels 30,32 may also be shut along the shaped perimeter 36 of the respective side panels at prechosen positions while maintaining an open seam. Finally, the ends 42,44 of the bottom panel 40 are folded over each other, and optionally over a portion of the chest flap zone 14 to form a folded wrapper around the hip, thigh, and upper leg of the individual. The folded ends 42,44 are held together by the closures 60 along the edges 48 of the bottom panel 40. In this manner, the entirety of the configured planar sheet becomes folded and wrapped around the body and limbs of the wearer.

Figure 4:
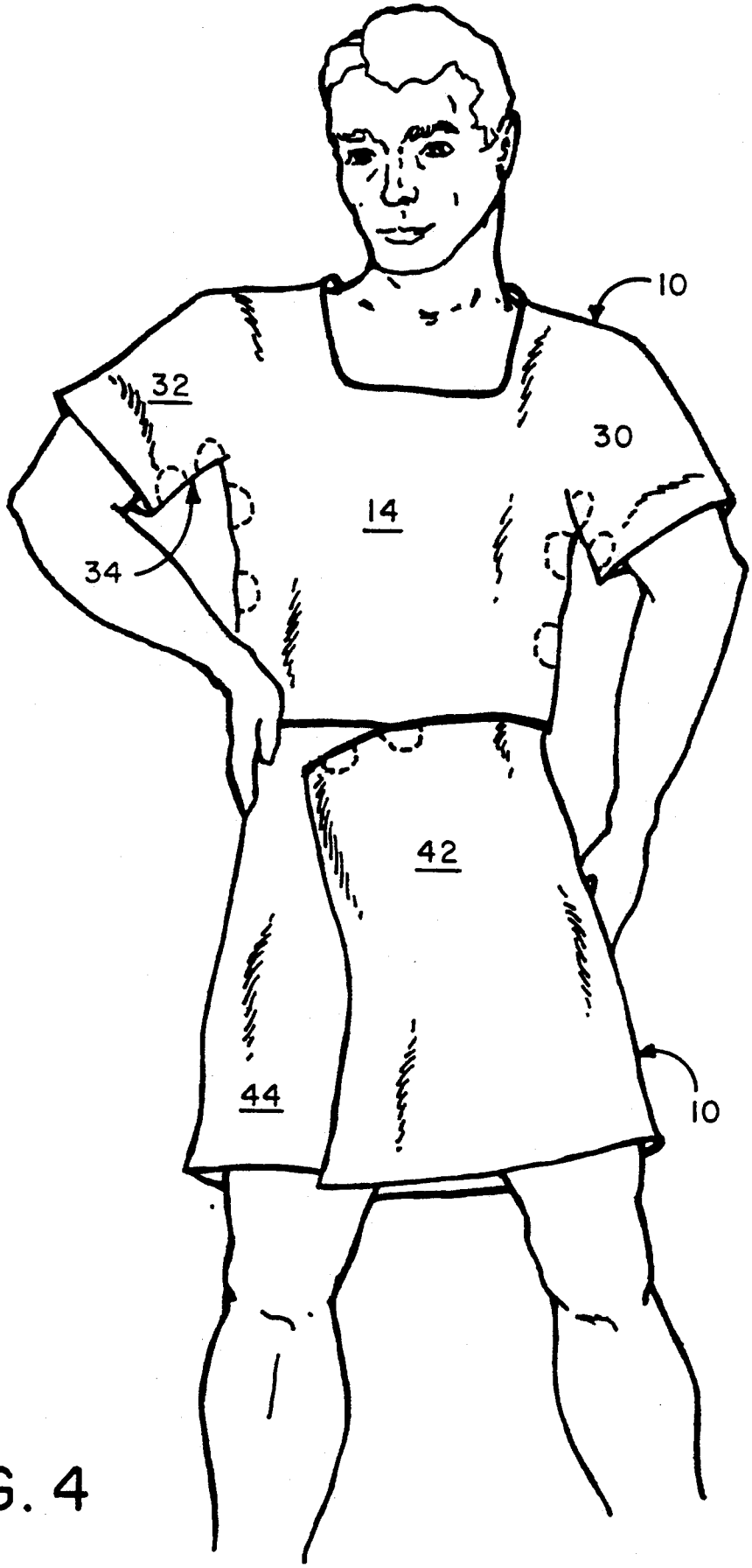
FIG. 4 is a frontal view of the fully draped, folded and wrapped garment of FIG. 1 as worn on the body and limbs of a person.
Figure 5:
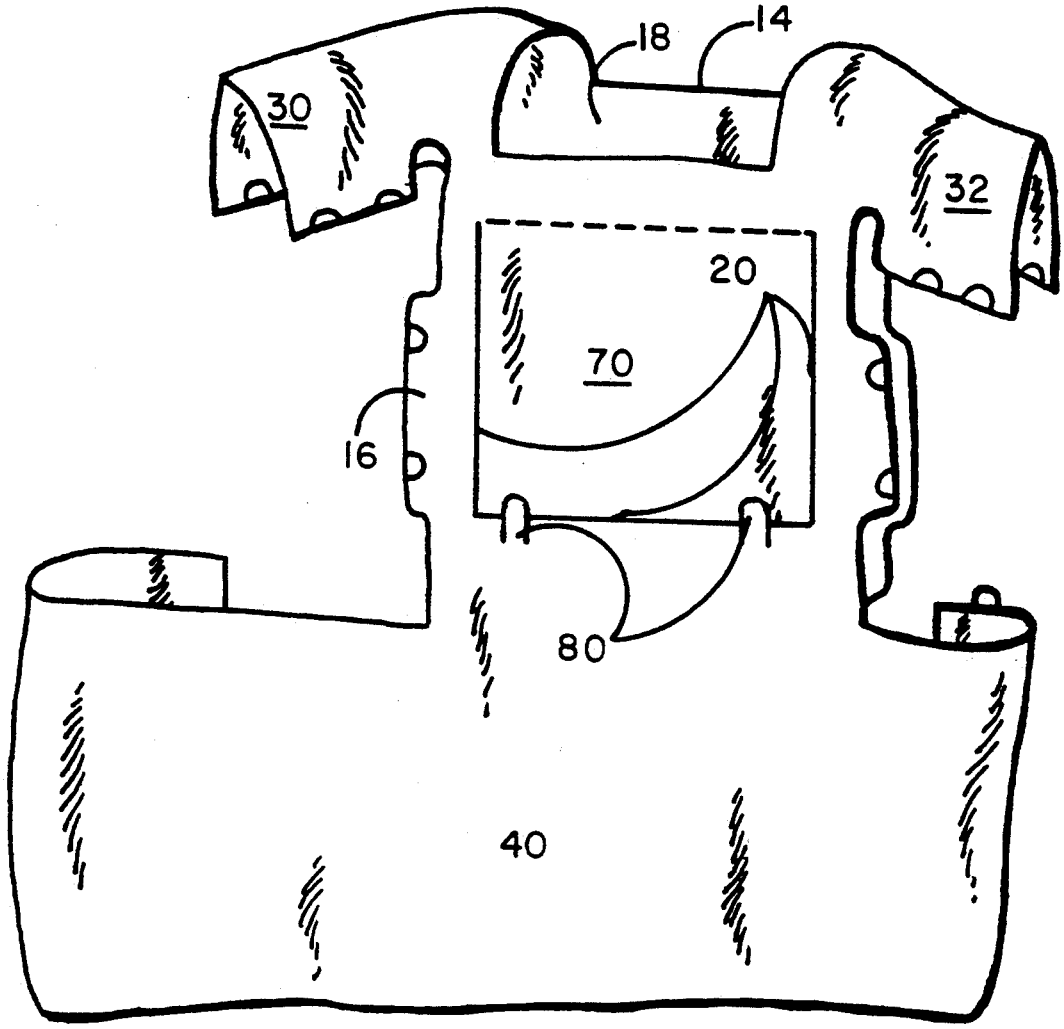
FIG. 5 is an alternative embodiment of the generic garment of FIG. 1.

The garment folded and wrapped around the body and limbs of the person is shown by FIG. 4. The configured sheet 10 not only covers the wearer completely front and back but also conforms to the body and limbs of the wearer in a manner which provides a comfortable and secure fit of the garment to the individual's needs. The open-seam edges of the garment which have been joined together along the shaped perimeter of the configured sheet 10 at prechosen positions provides open sleeves for the arms, a secure covering for the chest and back, and a folded wrapper around the hips, thighs, and upper legs. In addition, any portion of the garment can be opened at will to expose a limb, or a portion of the trunk of the body without exposing or uncovering any other portion of the body or limbs; and without requiring the person to remove the garment entirely at all. Note that the open-seam edges 34 of the configured first and second side panels 30,32 permit on-demand access to the arms and shoulder of the person whenever required. Similarly, the chest flap zone 14 may be lifted in part or in whole for direct examination and/or treatment of the chest. The genital area, the upper leg, and/or hip and thigh areas of the body may be individually uncovered and exposed as needed without uncovering the chest, back, shoulders, or arms. Lastly, the back of the individual is accessible for examination or treatment via the slits 20 in the back section zone 16 of the central panel 12. The generic garment requires at least one slit 20 to be present as a discrete feature in order that easier, on-demand access to the back exists. The value of this feature is shown in an alternative embodiment of the generic garment for frequent back access as illustrated by FIG. 5. As shown by FIG. 5, a plurality of slits 20 have been joined together within the back section zone 16 of the central panel 12 to form a back flap 70. The flap 70 may be lifted by the physician or nurse on-demand to uncover and expose substantially all of the spine and shoulder blade of the individual without uncovering any other part of the body. When access to the back of the person is not required, closures 80 hold the flap 70 firmly in position and provide a covering which is contiguous with the remainder of the configured sheet 10. In that manner, any and all aspects of the body and limbs may be accessed and exposed on-demand without necessitating removal of the garment or uncovering any other part of the body or limbs.

II. Variations and Details of the Component Parts Comprising the Generic Garment

The Panels

The garment is a unified construction created to provide an integral one-piece, open-seam configured sheet. The central panel, the first and second side panels, and the bottom panel may individually vary in geometric configuration, specific dimensions, and surface area. Clearly, the central panel is intended to provide covering for both the chest and back of the person; and thus may be shaped in a broad range of patterns and sizes to accommodate the expected range of height, weight, and body sizes. Similarly, the first and second side panels may be shaped and sized to provide a tighter or looser covering for the upper arms of the intended wearer. Accordingly, there is no size or shape restriction or limitation other than that the side panels cover at least a portion of the shoulder and arm in the fully constructed garment. Similarly, the configured bottom panel must be of sufficient dimensions and surface area to surround and encompass the girth of the person completely. There is expected and intended to be a wide diversity and range of hem length; and the edge of the bottom panel will generally rise and fall in ratio with the height and stature of the individual. In sum, therefore, there are no meaningful limitations whatsoever on the shape, size, dimensions, or general appearance of the individual panels comprising the fully constructed, integral configured sheet.

The opening or aperture in the central panel is intended and expected to be of sufficient shape and size to accommodate the head and neck of the wearer. In the generic garment construction, it is generally intended that the individual's head will actually pass through the opening in the central panel when putting on the garment. This, however, is not an absolute necessity in order to position and wear the garment. To the contrary, an alternative construction provides for additional open-seam edges to exist between and to join the opening to the shaped perimeter of the central panel at any point; and that one or more closures be positioned along these open seam edges similar to those closures previously described within FIGS. 1-5. In this alternative construction mode, the central panel thus may be opened along these edges and the person's neck slid through the midst of the central panel until it engages the opening of the central panel. The edges of this open seam are then joined together at prechosen positions by the closures along the edges thereby recreating and reforming the entirety and integrity of the central panel around the individual's head as previously described herein. In this manner, persons who have neck or head injuries and are unable to pass garments over their head are nevertheless able to place and position the present invention on their bodies without difficulty or incurring either pain or discomfort.

The slits 20 when appearing within the back section zone of the central panel are desirably present in multiple form as illustrated by FIGS. 1 and 3 respectively; and are preferably fashioned as a slitted pleat rather than a raw, unadorned cut in the fabric of the central panel. The formation of a pleated slit is conventionally known; provides reinforcement for the fabric material forming the back section zone; and also allows for a more comfortable form of textile construction which provides immediate, on-demand access to the spine and shoulder blades of the wearer. The pleated slit is a well recognized and conventional form of tailoring and textile manufacture commonly used in the garment industry and thus requires no intensive description herein.

Closures

The closures of the present invention, being situated at prechosen positions along the edges forming open seams or gaped seams for the configured sheet, provide both a useful and important function to the user. The presence of these closures provide the capability to join and unjoin selected portions of the open-seam edges along the shaped perimeter of the garment; and allow the wearer to pick and choose the location and degree of garment conformity to the body and limbs such that a proper and comfortable fit is achieved. The closures prevent the various panels and zones comprising the garment from flapping or billowing; and also provide a unitary covering over those portions of the body where the individual has greatest need. The closures are therefore positioned at prechosen locations and the wearer may use or not use any of the closures as he sees fit. The closures also provide the capability to achieve a tighter or looser size and fit for the individual in accordance with his personal desire or needs.

A broad and diverse range of different closures and closure constructions may be employed with the present invention. Merely representative of this range are velcro fasteners, snaps, hook and eye connectors, buttons, string ties, and even zippers. All of the above examples represent durable and long-lasting forms of closures; and all of them are conventionally known and commercially available in many materials. In some embodiment, however, a fragile, non-enduring closure construction might be desirable, especially in one time use, throw away embodiments. Representative examples of non-durable enclosures suitable for use with the present invention include adhesives in spot, tape, or patch form; removable clips and fasteners, and even pins of various kinds. These latter examples are not permanent fixtures and attachments to the fabric of the configured sheet and presumably may be removed and/or lost as a result. These, therefore, constitute the least desirable forms of closures which may be employed with the invention. Accordingly, it will be recognized and understood that any form of conventionally known closure may be employed regardless of its construction, material, or mode of use so long as it can be positioned at prechosen sites along the open-seam edges of the configured garment.

III. Materials for Constructing the Garment and Expected Mode of its Manufacture The materials which are suitable for use when manufacturing the present invention need demonstrate and provide only a very few attributes and characteristics. These are: flexibility; the ability to be formed into a textile or fabric sheet without substantial deterioration; the ability to be configured and dimensioned in accordance with preselected specifications; and, in certain embodiments, the ability to be joined together as components parts when forming a single, unitary and integrated construct. No other parameters are of meaning or importance.

Accordingly, the choice of materials to be used in making the central panel, the first and second configured side panels, and the configured bottom panel may be chosen from any and all materials, fibers, and compositions conventionally known for such a purpose. The choice of compositions and materials will thus vary substantially from those materials which are resilient, tough, demonstrate high tensile strength, are durable, and impervious on one extreme-to the fragile, tenuous, flimsy, and easily torn, broken, or shattered compositions of matter at the other extreme. It is expected and intended that a textile fabric-either woven or unwoven, of single or multiple derniers, and of laminated or unlaminated construction with or without underlying reinforcements-will be employed to provide a substantially planar sheet which is flexible, foldable, and relatively comfortable against human skin. To fashion garments of long duration which will be cleaned on multiple occasions and used again repeatedly, the traditional fibers of cotton, linen, with or without synthetics such as polyesters or other polymer blends are envisioned. Any and all fibers, textiles, and cloths currently available and/or conventionally employed in the manufacture of clothing or other garments are acceptable. Alternatively, in the single use or throw-away embodiments of the invention, it is expected that sheets composed of paper or other natural pulps and fibers may be employed; and also a wide variety of, especially synthesized, polymers such as Tyvek film will be used as well. It is preferable also that the materials employed in making the garment or configured sheet be biocompatible, non-toxic, and non-allergic to avoid unwanted and unnecessary skin interactions.

The manufacture of the present invention may be easily achieved following the conventional and traditional tailoring and garment making technology available today. It is expected and intended that the method of cloth cutting, shaping, joining, and finishing will be employed in accordance with the customary standards employed for articles of clothing manufactured and/or solid within the United States. The garment comprising the present invention may be created by hand in whole or in part; or be formed by automated machine processes in part or in whole. For example, the generic garment illustrated by FIG. 1 may therefore be cut directly from a bolt of cloth as a single piece construction following a prechosen tailoring cut-out or pattern. Alternatively, separate and discrete central panels, side panels, and bottom panels may be individually fashioned and joined together along their edges to form a unitary and integrated single construct. There is no meaningful difference between the alternate modes and manners of manufacturing; and the finished garment as an article of manufacture will be functionally similar or identical regardless of which method of manufacture was actually employed.

IV. Preferred Embodiments of the Present Invention

Figure 6:
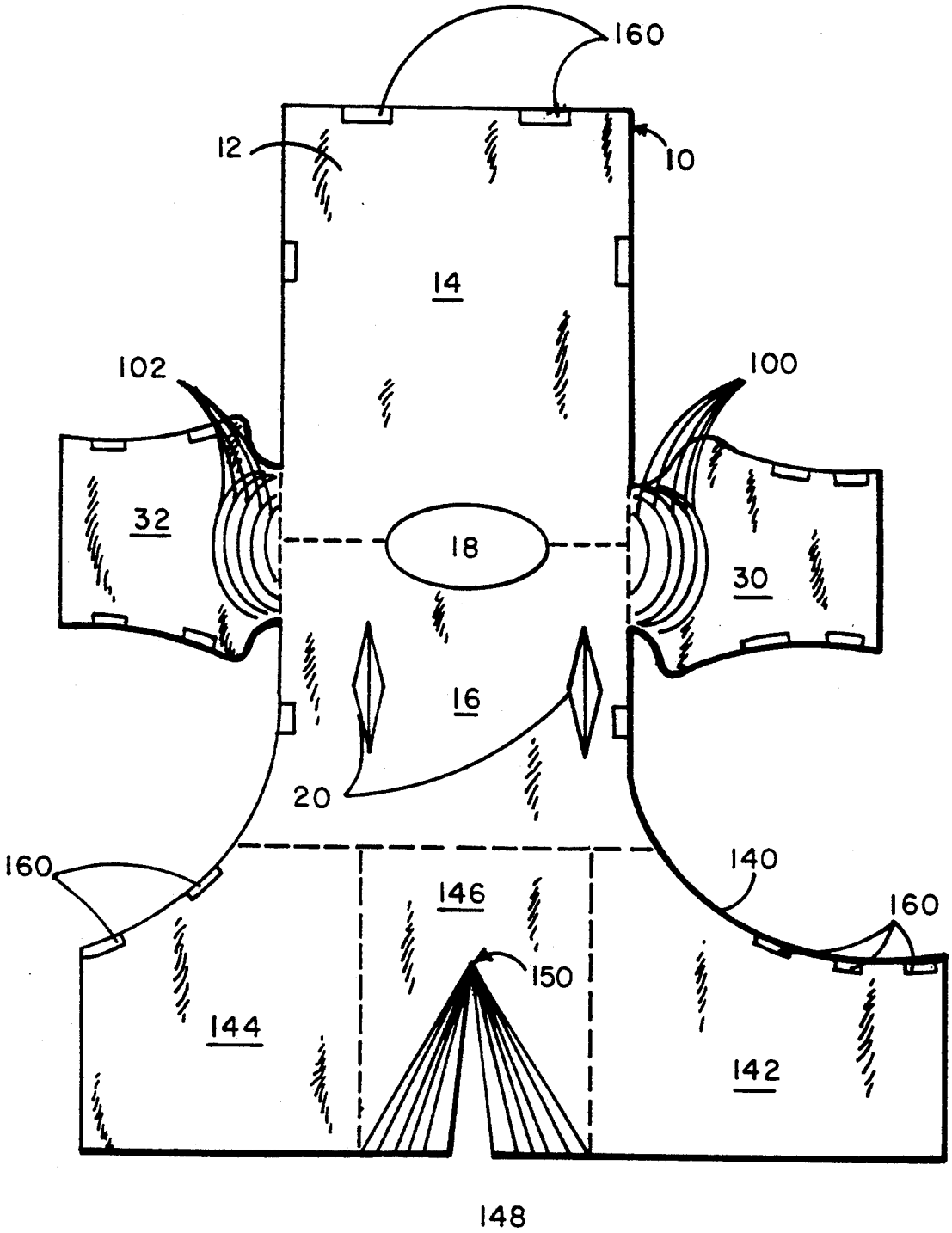
FIG. 6 is an overhead view of an unfolded, first preferred embodiment of the present invention.
Figure 7:
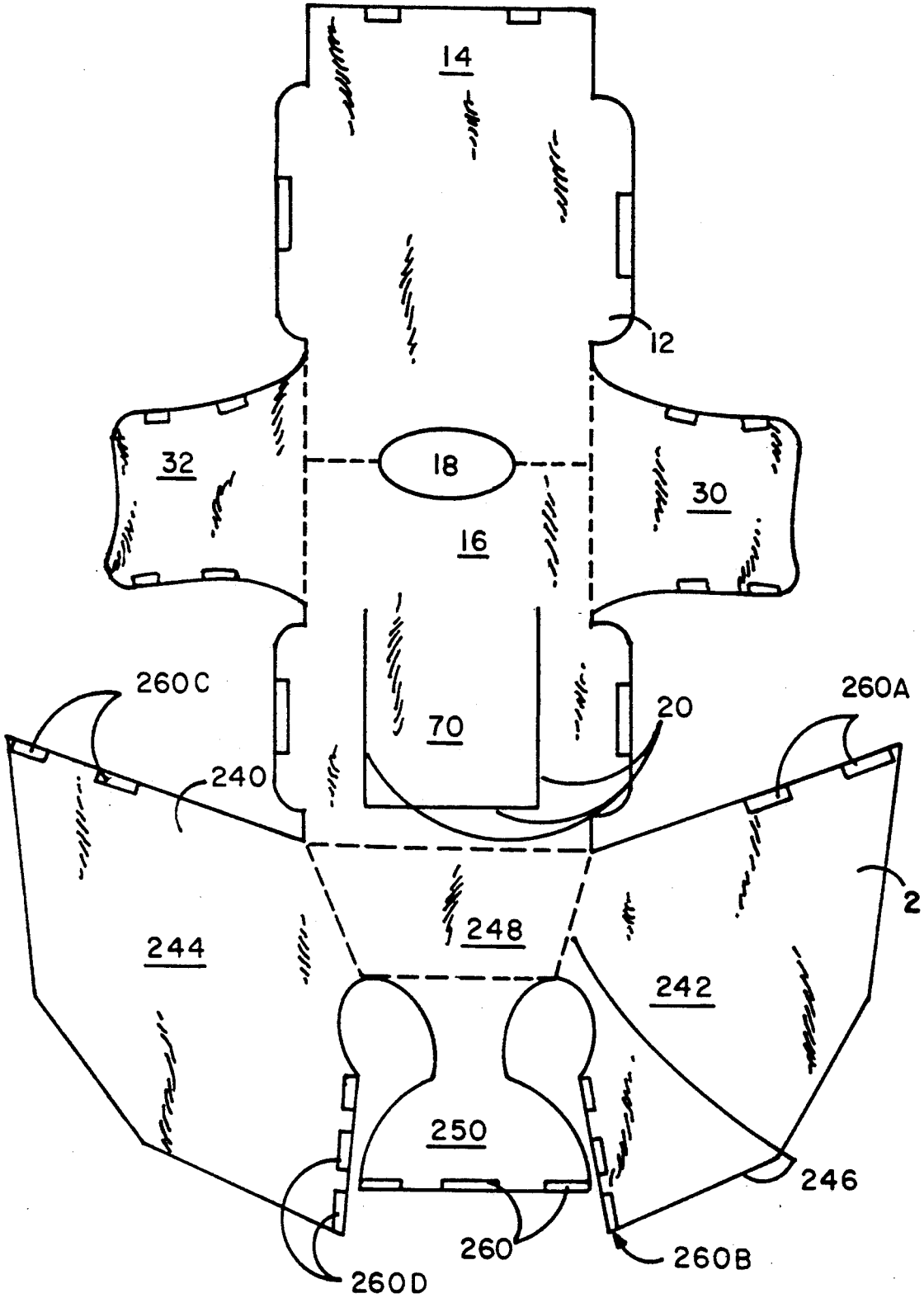
FIG. 7 is an overhead view of an unfolded, second preferred embodiment of the present invention.
Figure 8:
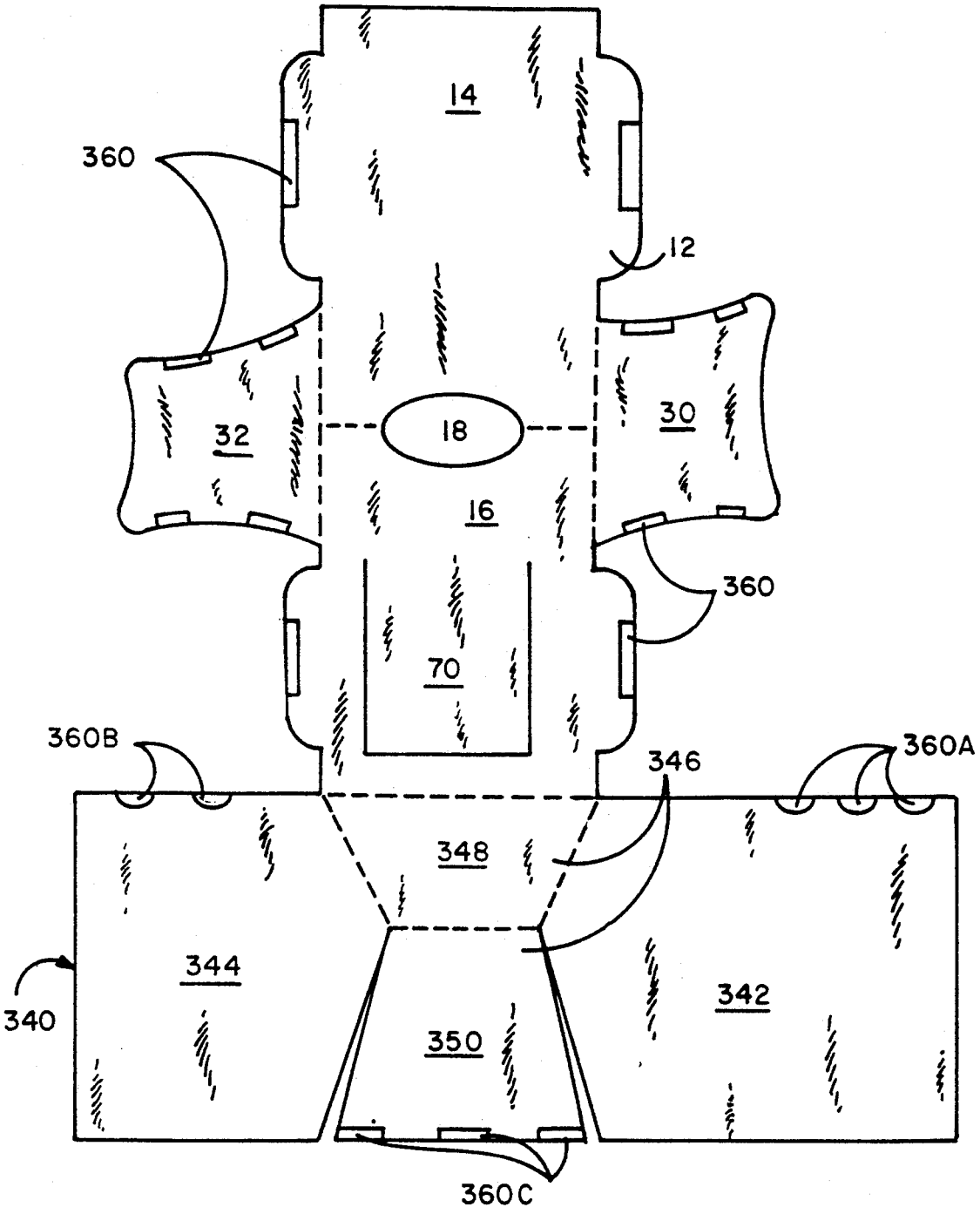
FIG. 8 is an overhead view of an unfolded, third preferred embodiment of the present invention.

Three different preferred embodiments of the generic garment are illustrated by FIGS. 6, 7, and 8 respectively. Where possible, the description of these three preferred embodiments will conform to the generic garment of FIGS. 1-3. The major differences and improvements over the generic garment will be disclosed in detail.

The preferred embodiment of FIG. 6 again reveals a configured sheet 10 comprising a central panel 12; first and second configured side panels 30,32; and an altered bottom panel 140. The central panel 12 provides the chest flap zone 14, the back section zone 16. the opening 18, and the slots 20 as previously described. The side panels 30,32, however, are configured and constructed in such a manner that a series of overlapping folds or pleats 100,102 are situated adjacent to the central panel 12. These side panel folds 100,102 provide on-demand expansion of the side panels at the shoulder line of the wearer; and provide an expansion of the cloth in the form of a puffed-shoulder or sleeve for added comfort and surface area if and when needed. The side panel folds or pleats 100,102 are thus an optional feature which add not only stylistic fashion but also substantive comfort and fit for those persons with plaster casts at the shoulder or those individuals who have been surgically operated on the upper arm and back.

The configured bottom panel 140 appears substantially trapezoidal in shape and is again arbitrarily divisible into a first bottom end 142, a second bottom end 144, and a middle area 146. In this embodiment, the first bottom end 142 is larger in fixed surface area than its counterpart second bottom end 144; and both ends 142,144 are configured as tapered flaps which are intended to be folded over the stomach and genital area of the wearer to form a skirt-like wrapper. The middle area 146, however, has been meaningfully altered in construction to provide a substantially triangular-shaped split pleat 148 which is desirably reinforced at its apex 150 for strength and continuity of fabric. The split pleat provides a greater freedom of movement for the individual when fitted or walking; and allows the middle area 146 to conform to the movements of the buttocks and legs when sitting and walking with a much improved comfort and convenience for the user. It is expected and envisioned that women, more than men, will find this embodiment preferable to the generic construction of the garment as in FIGS. 1-3.

The matter of folding and wrapping the garment of FIG. 6 is illustrated by the closure strips 160 which are positioned along the edges of the bottom panel 140 and the edge of the chest flap zone 14. When the head and neck is accommodated via the opening 18 of the central panel 12, it is expected that the first and second ends 142,144 of the configured bottom panel 140 will be folded over each other initially; and that the chest flap zone 14 will then subsequently be placed and joined to the bottom panel 140 as an overlying layer. While this manner of folding is not mandatory, it is seen as the most expedicious and effective way of folding and wrapping this first preferred embodiment.

The second preferred embodiment is illustrated by FIG. 7 and reveals another major variation and format for the configured bottom panel of the garment. As previously described, the central panel 12 again includes the chest flap zone 14, the back section zone 16, the opening 18, and slots 20 forming the flap 70. The first and second configured side panels 30,32 again individually lie adjacent to the central panel 12 as previously described herein. The configured bottom panel 240 is markedly different in this second preferred embodiment; but is again divisible into a first bottom end 242, a second bottom end 244, and a middle area 246. The first and second bottom ends 242,244 are substantially identical in dimensions and fixed surface area; and are substantially polygonal in shape. The middle area 246 is itself divisible into a discrete median zone 248 and a discrete flap 250 which is substantially hour glass shaped in appearance. Along the open-seam edges of the configured bottom panel 240 are a plurality of closure strips 260. The attraction and value of this preferred embodiment is revealed best by the manner in which the individual positions the garment on his person.

Initially, the head and neck are intended to pass through the opening 18 of the central panel 12; and the bulk of the configured sheet is supported on the body along the shoulders and upper limbs of the wearer. The individual then takes hold of the hour glass shaped flap 250 and passes this flap between his or her legs and up over the genital area and stomach to make contact with and engage the edge of the chest flap zone 14 extending downwardly. In this manner, the median zone 240 lies adjacent to and covers the buttocks of the individual while the flap 250 serves as a textile layer forming a panty and crotch which encompasses the genital area and stomach concurrently. The flap 250 is maintained in this extended position via the closure strip 260 on the flap 250 and via its proximate contact and engagement with the chest flap zone edge of the central panel. The fitting and positioning is thus secure and is maintained until a need or desire to expose the stomach or genital area arises.

The folding of the first bottom end 242 and the second bottom end 244 of the configured bottom panel 240 is also markedly different in this embodiment. The first end 242 is folded over itself bringing the closure strip **260*a* into direct contact with closure strip 260*b*. By this manipulation, one leg of the person becomes covered and enclosed by the folded first end 242 alone; and the union of the closure strips 260*a* and 260*b* form a flowing, loosely shaped pantaloon which effectively covers that lower limb. In a similar manner, the second end 244 is folded over itself such that the closure strip 260*c* makes effective contact and union with closure strip 260*d*. By this manipulation, the thigh and leg of the other lower limb becomes covered and encompassed by the second end 244 alone; and consequently is clothed in a loosely draped sleeve or pantaloon which covers and protects the lower limb. The overall effect of folding the first and second bottom ends 242,244—combined with the prior extension and folding of the flap 250—results in a fully formed "harem pant" construct in which the lower half of the body and both lower limbs are covered and protected. Equally important, because the closure strips 260*a*-260*d*** collectively may be repeatedly shut and reopened as needed or required on-demand, the entirety of the lower body and/or either of the limbs individually or together may be exposed when desired.

A useful and desirable feature of this second preferred embodiment also is that while either leg may be individually exposed at any time for examination or treatment, the buttocks and genital area and stomach and upper chest all remain covered and protected throughout the entirety of the examination or treatment procedure. The modesty and privacy of the person's private parts is thus protected even in those instances where intimate contact and exposure of the upper leg and thigh is necessary. It is envisioned, therefore, that this embodiment will be most preferred by men and women alike.

The third preferred embodiment is illustrated by FIG. 8 and reveals another major variation and format for the configured bottom panel of the garment. As previously described, the central panel 12 again includes the chest flap zone 14, the back section zone 16, and the opening 18, and slots 20 forming the flap 70. The first and second configured side panels 30,32 are each individually lying adjacent to the central panel 12 as previously described herein. The configured bottom panel 840 is once more different in this third preferred embodiment; but is again divisible into a first bottom end 342, a second bottom end 344, and a middle area 346. The first and second bottom ends 342,344 are substantially identical in dimensions but differ in size and surface area; each is substantially rectangular in shape. The middle area 346 is itself divisible into a discrete median zone 348 and a discrete flap 350 which is substantially polygonal in appearance. Along the open-seam edges of the configured bottom panel 340 are a plurality of closure strips 360*a*, 360*b*, and 360*c*. The attraction and value of this third preferred embodiment is also revealed best by the manner in which the individual positions the garment on his person.

Initially, the head and neck are intended to pass through the opening 18 of the central panel 12; and the bulk of the configured sheet is supported on the body along the shoulders and upper limbs of the wearer. The individual then takes hold of the polygonal shaped flap 350 and passes this flap between his or her legs and up over the genital area and stomach to make contact with an engage the edge of the chest flap zone 14 extending downwardly. In this manner, the median zone 340 lies adjacent to and covers the buttocks of the individual while the flap 350 serves as a textile layer forming a panty and crotch which encompasses the genital area and stomach concurrently. The flap 350 is maintained in this extended position via the closure strip 360*c* on the flap 350 and via its proximate contact and engagement with the chest flap zone edge of the central panel. The fitting and positioning is thus secure and is maintained until a need or desire to expose the stomach and genital area arises.

The folding of the first bottom end 342 and the second bottom end 344 of the configured bottom panel 340 is also different in this embodiment and follows that of the garments shown in FIGS. 1–3. The second bottom end 344 is folded over the flap 350; and the first bottom end 342 is wrapped over both the end 344 and the flap 350 to form a skirt. The closures 360*b* and 360*a* hold the wrapped bottom ends 344,342 in place. By this manipulation, the legs and thighs of the person become covered and enclosed by a flowing, loosely shaped wrap-around skirt. The overall effect of folding the first and second bottom ends 342,344 combined with the prior extension and folding of the flap 350 results in a fully formed panty and skirt construct in which the lower half of the body and both lower limbs are completely covered and protected. Equally important, because the closure strips 360*a*, 360*b*, 360*c* collectively may be repeatedly joined and opened as needed or required on-demand, the entirety of the lower body and/or either of the limbs individually or together may be exposed when desired.

V. Optional Features

One of the desirable advantages and benefits provided by the present invention is the capability of placing one or more pads, buffers, and other drug delivering or fluid absorbing cloth and textiles upon the garment as an optional feature. It will be recognized and appreciated that the composition of the cloth or pad, its intended function and purpose, and its position relative to the body will all vary considerably with the person's individual physical condition and medical needs. Recognizing this controlling and dominating factor, the range and variety of pads and textiles which are suitable for use are substantially without limitation or restriction.

Pad Composition and Configuration

The materials employed for manufacturing pads, textiles, cloths, and the like are expected and intended to encompass all of the conventionally available materials, constructions, designs, and formats known in the technical literature and many of which are commercially available today. Thus, the materials include cotton, linens, polymers, and any other type of fiber which can be prepared in woven or non-woven form to form a fabric or textile. Many of these materials may comprise more than one layer; can comprise laminated forms and structures; be prepared in one or more deniers of fabric to provide varying thicknesses; and be configured in a variety of different regular and irregular geometric shapes. Accordingly, neither the materials, mode of manufacture, format construction, porosity, or permeability are controlling parameters.

In many instances, the pad or textile thickness will be employed to absorb bodily fluids of one kind or another. The presence of absorbent pads having multiple layers, one of which is fluid absorbing and the other of which is fluid impermeable, is a conventional article commonly used in clinics, hospitals, and physician's offices. In addition, one or more absorbent pads or textiles are commonly used to construct a variety of different fluid absorbing articles which have been molded or shaped to fit comfortably at particular locations on the body. A representative example is a sanitary pad or napkin used by women to absorb menstrual flow or vaginal discharges. Another example is the cup shaped absorbent pads used by nursing mothers to absorb discharges of milk from the breast. A third example is incontinence pads of varying size and thicknesses which often are employed to control diarrhea as well. Probably the most commonly known absorbent pads are those cotton squares and rectangles used to absorb fluid discharges on the skin caused by cuts, scratches, wounds, and the like. All of these absorbent function capabilities are an optional feature of the present invention.

In addition, pads and other textiles are frequently used to administer drugs and medications topically on the skin at one or more sites on the body and limbs. Skin patches containing nitroglycerin are a common example. Similarly, the use of a cotton patch purposefully saturated with a topical antibiotic ointment or similar pharmaceutical preparation in cream or ointment form is commonly placed against the skin as an effective mode of treatment. It is intended and expected that the inclusion and use of pads and textiles for administration of pharmacologically active compositions is a desirable advantage and benefit provided by the present invention.

Placement and Support

The one-piece, open-seam garment comprising the present invention provides alternate modes for positioning and using the individual pads and textiles. In general, it is of no importance how the individual pads, cloths, and textiles are positioned; or how the individual pads are held in place on the garment for the required duration. It is known that a wide variety of different means of support and positioning are conventionally available for this purpose and thus all of these are deemed to be part of the invention as a whole.

Nevertheless, of the many different means of support, two modes in particular are worthy of description herein. These two modes are illustrated by FIGS. 9 and 10 respectively.

Figure 9:
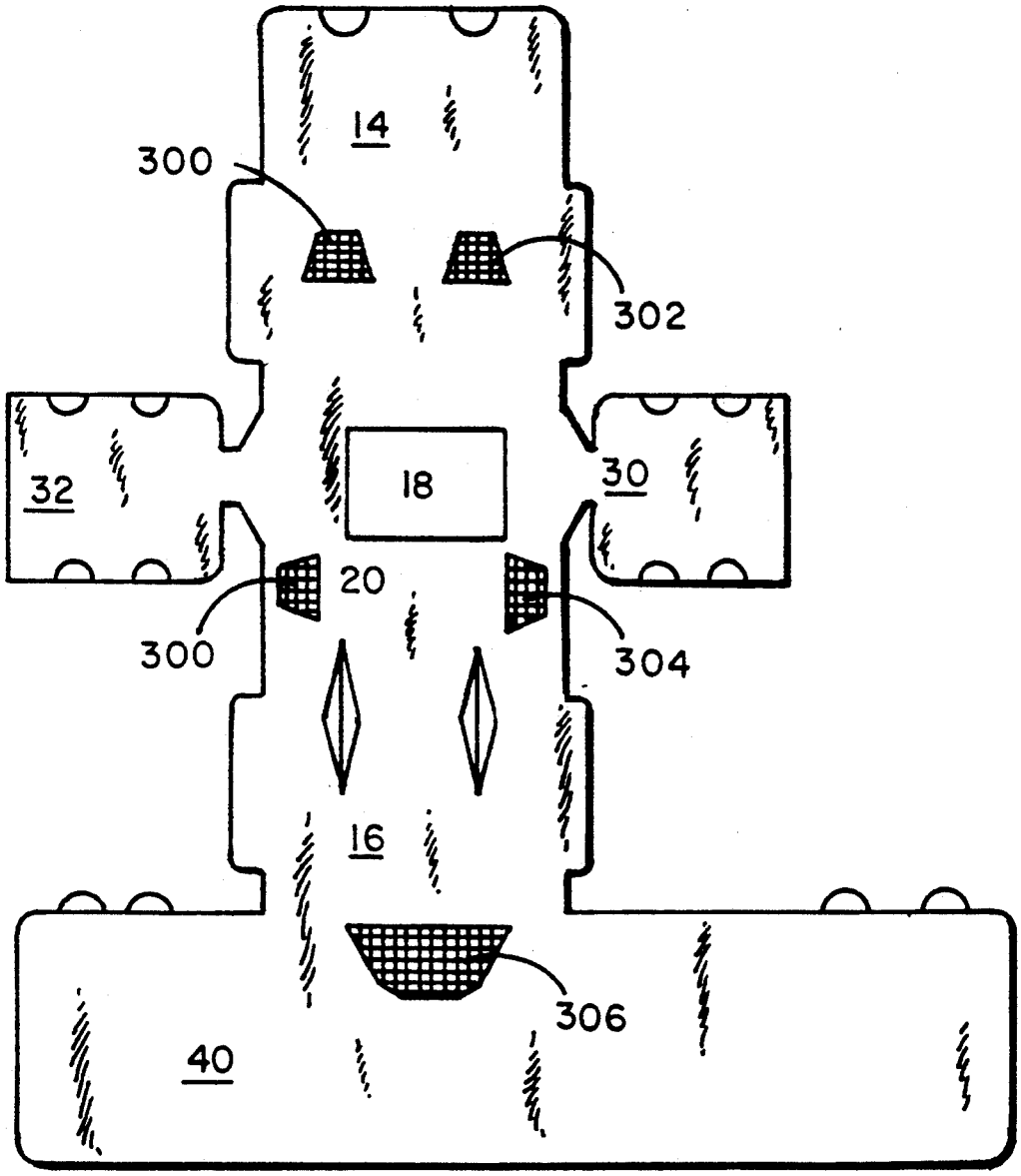
FIG. 9 is a reproduction of FIG. 1 illustrating the netting support means.

As shown in FIG. 9, the generic garment of FIG. 1 is reproduced. Attached to the configured sheet 10 at multiple locations, are a variety of different sized nettings 300 which have been joined to the surface area of the garment and which provide a porous, open-mesh envelope or casing into which a pad is placed. Thus, positioned within the chest flap zone 14 are chest nettings 302 which are intended to receive pads of absorbent material and will function as cloths able to absorb fluid discharges from the breasts. Similarly, armpit nettings 304 are positioned within the back section zone 16 and will hold a plurality of absorbent pads in position in and around the armpit area of the body. Lastly, incontinence netting 306 is situated within the configured back panel at a position intended to lie adjacent to the buttocks and legs of the wearer. This incontinence netting 306 will receive and support in position an enlarged absorbent pad or cloth intended to absorb the fecal discharges from the individual while the garment is worn. By the construction disclosed within the garment of FIG. 9, the netting 300 remains a permanent feature and fixture of the garment itself; and it is intended that the various pads will be replaced as often as necessary to meet the needs of the user.

Figure 10:
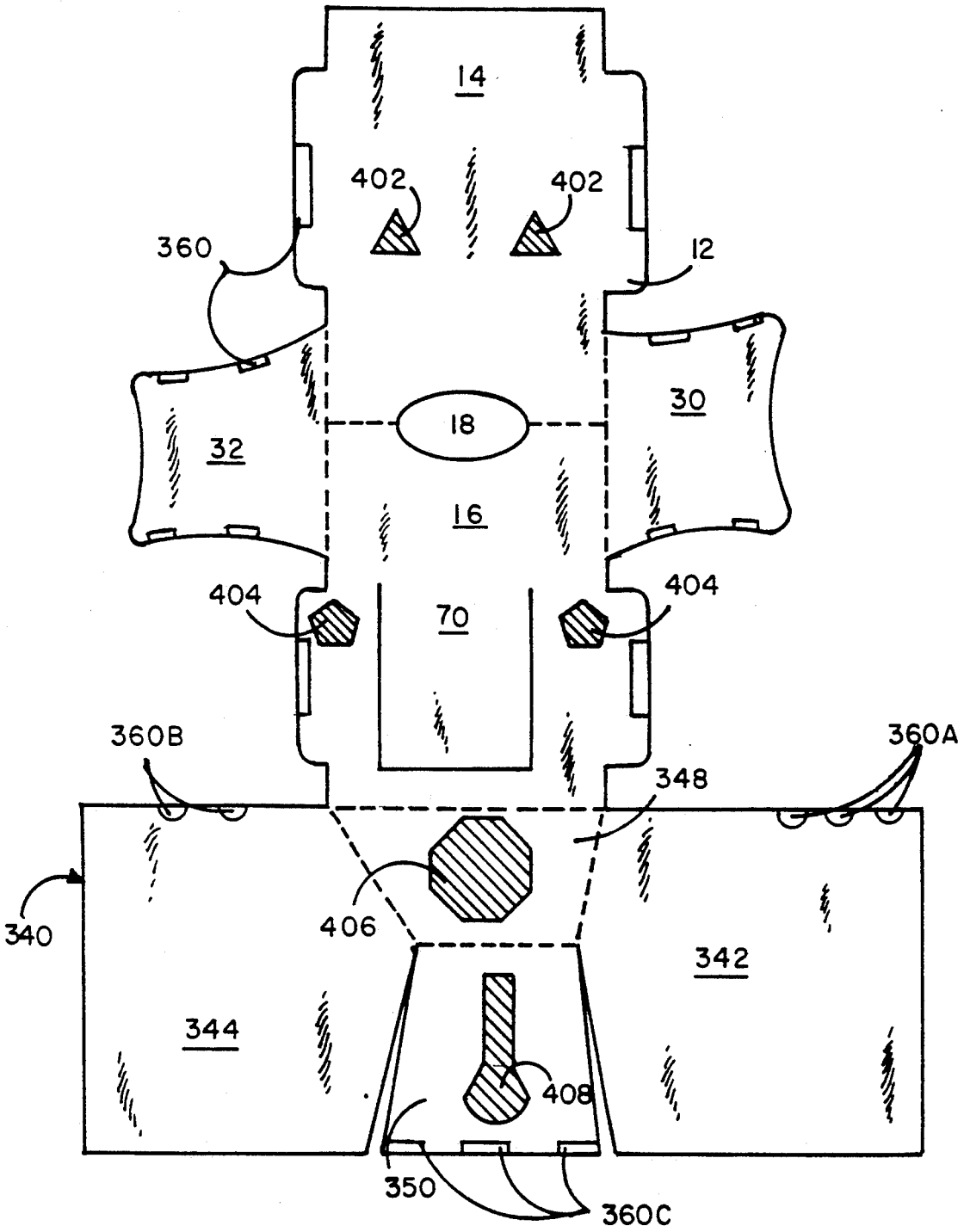
FIG. 10 is a reproduction of FIG. 8 illustrating the presence and placement of absorbent pads with self-adhering backings.

In comparison, a different construction is intended by the garment illustrated within FIG. 10 which is a reproduction of the configured sheet previously described by FIG. 8 herein. In this embodiment, it is preferable that the pads, cloths, textiles, and the like each have a self-adhesive backing which then allows the pad to be positioned and repositioned at will anywhere over the surface area of the configured sheet itself. All of the pads 400 seen within FIG. 10 have self-adhesive backings which hold the pad on the garment at the chosen location; and allows the used pad to be removed and replaced on a regular schedule or in accordance with the needs of the wearer. Thus, as shown by FIG. 10, two triangular-shaped absorbent pads 402 are present upon the chest flap zone 14 and are intended to absorb such discharges as may occur from the breasts. A particular advantage of the self-adhering pad is that the individual may change the position of the pad as needed and thus place the pad in the most comfortable and effective location to achieve its intended purpose. A self-adhesive backing of the pad allows removal and replacement of the armpit pad 404 in this manner such that a custom fit and maximum convenience for the individual is obtained. Similarly, the incontinence pad 406 has a self-adhering backing and thus may be adjusted to be most effective and least embarrassing for the person. Lastly, a conventional sanitary napkin 408 with a self-adhering backing has been placed on the extended flap which will cover and protect the genital area of the female wearer. In accordance with customary practice, the sanitary napkin can be replaced as often as necessary during the menstrual cycle or during excessive vaginal bleeding or discharge without soiling the remainder of the garment. The self-adhering backing of the sanitary napkin also permits individual and comfortable placement for the duration the garment is worn.

The present invention is not to be restricted in form nor limited in scope except by the claims appended hereto.

What I claim is:

1. A one-piece, open-seam garment which encompasses the head of the wearer, covers the body and the limbs of the wearer, and provides on-demand access to one portion of the covered body and limbs without uncovering the remainder of the body and limbs, said garment comprising:

a single, flexible, and integral configured sheet which is substantially planar, has open-seam sides, and has a fixed surface area providing at least (a) an open-seam central panel formed as a strapless chest flap zone for covering the chest joined opposite to a strapless back section zone for covering the back, said chest flap zone and said back section zone each being of a length sufficient to reach from about the shoulder to at least the waist of the wearer, and said chest flap zone and said back section zone each having a plurality of open-seam sides for engagement of the opposite zone on-demand, (b) an opening in said central panel sufficiently large to accommodate the head of the wearer therethrough, (c) first and second open-seam, configured arm panels joined to said central panel adjacent said strapless chest flap and back section zones, each of said arm panels individually being able to cover at least a portion of one upper limb of the wearer as a sleeve having a plurality of open-seam sides for engagement on-demand, (d) a single, open-seam, configured bottom panel joined to said back section zone of said central panel, said bottom panel having a plurality of open-seam sides and being of sufficient surface area and dimensions to be folded around and to cover the buttocks, the genital area, and at least a portion of the lower limbs of the wearer, such that at least two open-seam sides of said bottom panel extend forward around the wearer to overlap each other markedly and lie markedly overlapped against a portion of said chest flap zone of said central panel, each of said overlapping open-seam sides of said bottom panel engaging the other overlapping side on-demand; and a plurality of on-demand closures spaced from each other at prechosen positions along said open-seam sides of said configured sheet for repeated engagement and closure of said open-seam sides on demand.

2. The garment as recited in claim 1 further comprising at least one slit within said back section zone of said central panel.

3. The garment as recited in claim 1 further comprising a plurality of slits within said back section zone of said central panel.

4. The garment as recited in claim 3 where said plurality of slits form a discrete flap within said back section zone of said central panel.

5. The garment as recited in claim 1 further comprising at least one porous netting positioned on the surface of said configured sheet.

6. The garment as recited in claim 1 further comprising at least one absorbent patch positioned on a surface of said configured sheet.

* * * * *